US009307874B2

(12) United States Patent
Smith

(10) Patent No.: US 9,307,874 B2
(45) Date of Patent: Apr. 12, 2016

(54) APPARATUS AND METHOD FOR ENHANCED PERSONAL HYGIENE

(76) Inventor: Kevin L. Smith, Draper, UT (US)

( * ) Notice: Subject to any disclaimer, the term of this patent is extended or adjusted under 35 U.S.C. 154(b) by 268 days.

(21) Appl. No.: 13/977,109

(22) PCT Filed: Jul. 19, 2011

(86) PCT No.: PCT/US2011/001282

§ 371 (c)(1),
(2), (4) Date: Aug. 12, 2013

(87) PCT Pub. No.: WO2013/012402

PCT Pub. Date: Jan. 24, 2013

(65) Prior Publication Data

US 2014/0115799 A1 May 1, 2014

(51) Int. Cl.

| | |
|---|---|
| ***A47K 7/04*** | (2006.01) |
| ***A61H 7/00*** | (2006.01) |
| ***A61H 23/02*** | (2006.01) |

(52) U.S. Cl.

CPC *A47K 7/04* (2013.01); *A61H 7/005* (2013.01); *A61H 23/02* (2013.01); *A61H 23/0236* (2013.01); *A61H 23/0245* (2013.01); *A61H 2201/105* (2013.01); *A61H 2201/503* (2013.01); *A61H 2205/022* (2013.01); *A61H 2205/065* (2013.01)

(58) Field of Classification Search

CPC ... A61H 7/005; A61H 23/0236; A61H 23/02; A47K 7/04

See application file for complete search history.

(56) References Cited

U.S. PATENT DOCUMENTS

| | | | | |
|---|---|---|---|---|
| 5,123,406 | A * | 6/1992 | Masuda | A61H 15/0092 601/120 |
| 7,451,513 | B2 * | 11/2008 | Torres | A47K 7/024 15/21.1 |
| 2006/0168746 | A1 * | 8/2006 | Guyuron et al. | A47K 7/04 15/97.1 |

FOREIGN PATENT DOCUMENTS

| | | |
|---|---|---|
| WO | 03024522 | 3/2003 |

* cited by examiner

*Primary Examiner* — Robert Scruggs

(57) ABSTRACT

An apparatus and method for enhanced personal hygiene. In one embodiment, a hand cleaner apparatus is disclosed. The hand cleaner apparatus includes an elongate grip having two ends. Each end has a scrubber area and a finger scrubber notch. In another embodiment, light emitting diodes and a timer are included in the hand cleaner apparatus to indicate passage of an appropriate cleaning time after activation of the hand cleaner apparatus. Other embodiments are also disclosed.

20 Claims, 4 Drawing Sheets

APPARATUS AND METHOD FOR ENHANCED PERSONAL HYGIENE

BACKGROUND OF THE INVENTION

1. Technical Field

The present invention relates in general to an apparatus and method for cleaning the human body. In particular, the present invention relates to a skin cleaner apparatus having a sonic and/or hypersonic motor to facilitate cleaning of human skin.

2. Description of the Related Art

Various forms of cleaning tools are known in the art of cleaning objects. For example, cleaning tools are known for cleaning the human body as well as for cleaning non-human objects. In the art of articles designed for cleaning the human body, cleaning articles are known such as an ultrasonic cleaner that is combined with a liquid cleaning solvent to clean a person's face (see U.S. Pat. No. 6,569,170).

In addition, to clean the human body, cleaning solutions are known to be combined with various articles that may assist with cleaning. For example, soap and water is known to be combined with a brush to assist with cleaning various areas of the human skin; likewise, soap and water is known to be combined with a sponge or a washcloth to provide a gentle abrasiveness to assist with skin cleaning. Other combinations of cleaning solutions and cleaning articles exist to encourage cleaning different areas of the human body for different purposes.

In the art of cleaning tools designed to assist in the cleaning of non-human objects, sonic and hypersonic motors are known to be used. These motors are used as part of cleaning tools in order to expedite cleaning time and to increase effectiveness of the cleaning of mechanical surfaces such as hospital equipment. In addition, these motors are known to assist with general cleaning and hygienic maintenance.

Cleaning tools that include both sonic and hypersonic motors are known to assist in cleaning hospital equipment such as surgical tables, surgical tools, and so forth. Further, in addition to simply cleaning hospital equipment, these sonic and hypersonic cleaning tools are even known to assist with sterilization procedures of equipment.

Beyond hospital equipment, cleaning tools having sonic and hypersonic motors are known to be used to assist in the cleaning of non-human objects such as motorcycle and auto engines, kitchen utensils, household fixtures, and other objects such as walls, tiles, and so forth.

In view of the prior art, efforts to improve upon human body cleaning articles have taken advantage of the benefits that can be realized by combining hardware cleaning tools with human body cleaning articles. However, efforts to improve upon human body cleaning articles appear to have focused on enhancing enjoyment of the cleaning process rather than utility. For example, prior art improvements to children's cleaning articles appear to have focused on simple aroma enticements (U.S. Pat. No. 7,350,256) or entertainment devices meant to positively encourage a child to properly clean their own body (U.S. Pat. App. No. 2010/0287720 A1).

Apparently, although ultrasonic technologies have been used to enhance adult skin cleaning articles such as the invention of U.S. Pat. No. 6,569,170, as demonstrated by the prior art, designers of prior art cleaning articles have apparently intentionally avoided using the sonic and ultrasonic technologies to enhance children's cleaning articles.

In addition, the ultrasonic cleaning tool designers appear to have focused on developing a gentle application of this ultrasonic technology. Apparently, the use of sonic cleaning technologies that have heretofore been used to create a more abrasive cleaning tool have focused on improving the cleaning of non-human mechanical devices.

As those of ordinary skill the art may know, cleaning the human body is not simply a chemical reaction of a cleaning solution contacting the human skin. Cleaning of the human skin relates to abrasion and the number of scrubs applied to the human skin in combination with application of the cleaning solution upon the human skin.

In view of the above related art, what is needed is a cleaning apparatus for cleaning the human skin that can offer enhanced scrubbing of human skin through increasing the number of scrubs that are offered by the cleaning apparatus. In addition, a cleaning apparatus is needed that encourages children to use the apparatus for a sufficient time to be thoroughly cleaned.

SUMMARY

It has been discovered that the aforementioned shortcomings are resolved by using a hand cleaner apparatus and method as described in the following Detailed Description of preferred embodiments of the present invention.

In one embodiment, the hand cleaner apparatus includes a sonic motor. The sonic motor is enclosed within an elongate pressure sensitive casing and includes a motor housing. The sonic motor is placed within the motor housing, and the sonic motor is coupled to a power source and may also be combined with a cleaning solution dispenser.

The power source and the cleaning solution dispenser are also enclosed within the pressure sensitive casing. In some embodiments, the sonic motor could be combined or replaced with an ultrasonic motor.

The casing includes at least one actuator built into it, and the casing actuator(s) also includes a timer. In combination with the timer, the actuator provides for both activation and deactivation of various elements of the hand cleaner apparatus. For example, when pressure is applied to the casing of the sonic motor, not only is the timer activated, but the sonic motor may be activated along with signal lights.

In certain embodiments, these signal lights are connected to the power source and the timer. When the signal lights are illuminated, the signal lights are visible to users of the hand cleaner apparatus. The signal lights are activated by applying pressure to the pressure sensitive casing of the hand cleaner apparatus.

After passage of a predetermined amount of time, deactivation of various elements of the hand cleaner apparatus may occur. For example, deactivation may include the sonic motor ceasing to operate after passage of the predetermined period of time. Alternatively, subsequent to the time period passing, the signal lights could darken or change colors to indicate that a sufficient amount of time has passed since activation. It is contemplated that either or both of these options could be part of the deactivation functionality of the hand cleaner apparatus.

For purposes of efficiency, deactivation can simply be referred to as a change in state. A change in state of the signal light, a change in state of operation of the sonic motor, a combination of the two changes in state, or other variations of the two combined with other hand cleaner apparatus actions such as distribution of cleaning solution. In addition, the signal lights could be realized with a simple light emitting diode (LED) arrangement or other form of small durable lighting that is familiar to those of ordinary skill in the art.

The hand cleaner apparatus also includes a first and a second scrubbing head disposed at a first and a second end of the apparatus, respectively. The scrubbing heads are mechanically coupled to each end of the sonic motor such that the scrubbing heads are moved by the sonic motor when the sonic motor is activated.

In alternative embodiments, the sonic motor of the hand cleaner apparatus is configured to rotate and/or vibrate the scrubbing heads when pressure is applied to the pressure sensitive casing. Each of the scrubbing heads may include both a scrubber area that vibrates upon activation and a finger scrubber notch that rotates upon activation. The timer can also be configured to measure passage of time only while pressure is applied to the pressure sensitive casing of the hand cleaner apparatus.

Regarding the activator, in alternative embodiments, a motion-sensitive activator could be used rather than a pressure-sensitive actuator. In other words, the sonic motor could be activated through abrupt movement of the hand cleaner apparatus.

In another embodiment, a method of cleaning hands is disclosed. The method includes the step of activating a hand cleaner apparatus that is constructed according to principles of the present invention.

The method further includes performing hand cleaning operations upon the activated hand cleaning apparatus. After performing the hand cleaning operations, hands and the hand cleaning apparatus are rinsed and the user releases the hand cleaner apparatus.

In variations of the method embodiment, the method could include performing hand cleaning operations by moving hands about the activated hand cleaner apparatus in an aggressive manner. This allows a gently abrasive scrubbing of skin to occur where the hand cleaner apparatus contacts the hands that are moved about the hand cleaning apparatus. Of course, this method could be repeated if the person recognizes that their hands have not been satisfactorily cleaned by the previously performed hand cleaning operations.

Upon viewing the present disclosure, one of ordinary skill in the art will appreciate that variations to the above disclosed apparatus and method could be contemplated.

The foregoing is a summary and thus contains, by necessity, simplifications, generalizations, and omissions of detail; consequently, those skilled in the art will appreciate that the summary is illustrative only and is not intended to be in any way limiting. Other aspects, inventive features, and advantages of the present invention, as defined solely by the claims, will become apparent in the non-limiting detailed description set forth below.

BRIEF DESCRIPTION OF THE DRAWINGS

The present invention may be better understood, and its numerous objects, features, and advantages made apparent to those skilled in the art by referencing the accompanying drawings.

DETAILED DESCRIPTION

The following is intended to provide a detailed description of examples of the invention and should not be taken to be limiting of the invention itself. Rather, any number of variations may fall within the scope of the invention, which is defined in the claims following the description.

Figure 1:
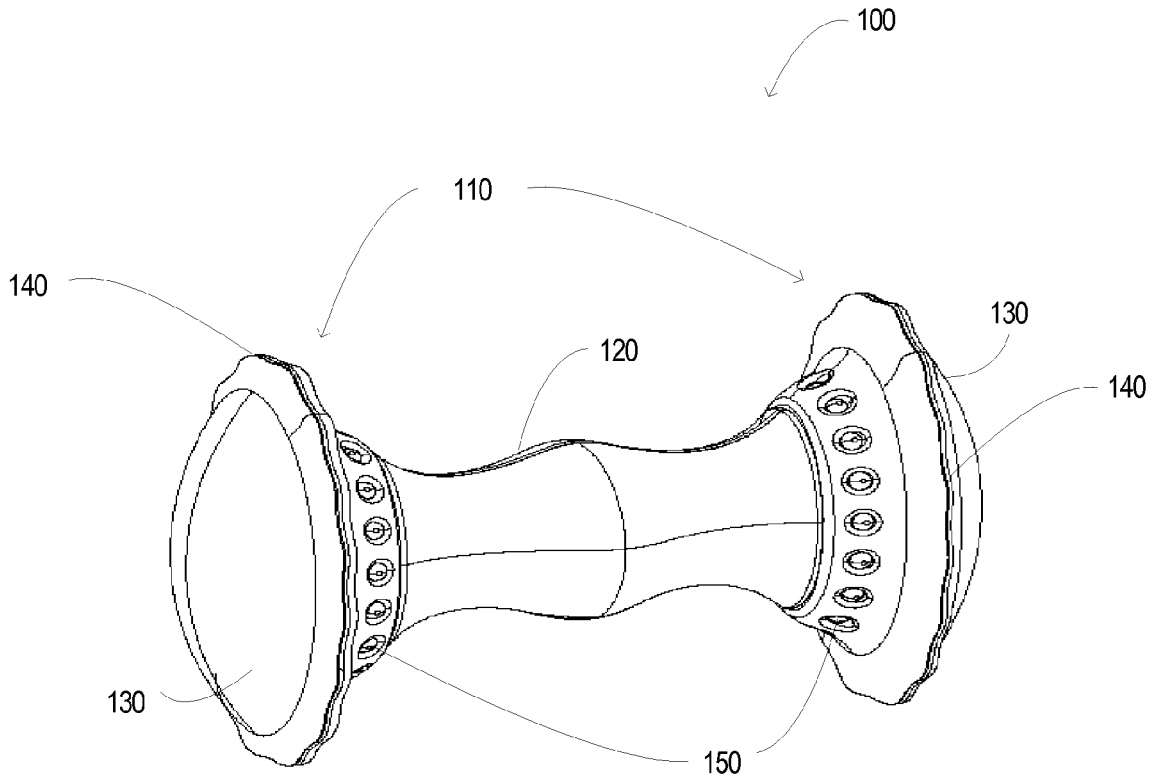
FIG. 1 is a perspective view diagram showing a general embodiment of a hand cleaner apparatus constructed according to principles of the present invention.

FIG. 1 is a perspective view diagram showing a general embodiment of a hand cleaner apparatus 100. Hand cleaner apparatus 100 is constructed according to principles of the present invention. In combination with the illustrated embodiment, the following description is intended to provide one of ordinary skill in the art a general description of a presently preferred embodiment of hand cleaner apparatus 100.

As illustrated, hand cleaner apparatus 100 includes two hand cleaner ends 110 which are separated by a hand cleaner grip 120. Hand cleaner grip 120 enables a user to grip hand cleaner apparatus 100 with at least one hand. However, in use, a user could grip hand cleaner apparatus 100 with one or both hands at either or both of hand cleaner ends 110.

Each of hand cleaner ends 110 is illustrated as including a scrubbing area 130 and a finger scrubbing notch 140. Scrubbing area 130 provides an area which facilitates scrubbing of skin surface areas of approximately the size of the palm of a hand or cheek on a person's face. To perform scrubbing, scrubbing area 130 is configured to vibrate. When vibrating, scrubber area 130 is particularly conducive to scrubbing skin areas of approximately the surface area size of the palm of a hand or cheek upon a person's face.

Finger scrubbing notches 140 facilitate scrubbing of smaller surface areas such as a finger, finger nail, or other bodily area such as between toes on a person's foot. Each of finger scrubbing notches 140 is configured to vibrate and rotate with respect to hand cleaner grip 120 and respective scrubbing areas 130. When hand cleaner apparatus 100 is activated, a user may grip one or both of hand cleaner ends 110, and with the finger nails of a hand, pinch or poke finger scrubbing notch(s) 140 to remove undesirable elements from beneath the user's fingernails.

Also disposed on each hand cleaner end 110 are light emitting diode (LED) apertures, two of which are identified as LED apertures 150. LED apertures 150 provide a space to allow an LED to be visible to a user of hand cleaner apparatus 100. The LEDs are configured to illuminate upon activation of hand cleaner apparatus 100. Subsequent to hand cleaner apparatus 100 activation and after passage of a predetermined time period, LEDs change state by darkening or changing colors.

It is contemplated that rather than, or in combination with the LEDs, an audible signal or demonstration such as music could be generated from within hand cleaner apparatus 100. This audible signal could be played in much the same way as LED activation/deactivation.

Hand cleaner apparatus 100 could be configured to allow selection of different styles or volumes of music to indicate the difference between activation and deactivation, or simply music on/off to indication such difference. In general, activation and deactivation signals of hand cleaner apparatus 100 are sometimes referred to herein as indicators.

In yet another embodiment, hand cleaner apparatus 100 could be configured to operate as a digital music provider when not being used for hand cleaning.

Upon viewing the present disclosure, it will be appreciated by those of ordinary skill in the art that multiple configurations may exist for activation of hand cleaner apparatus 100. For example, hand cleaner apparatus 100 could be activated through a motion-sensor disposed within hand cleaner apparatus 100, through pressure-sensitive actuators disposed within each of hand cleaner ends 110, through a pressure-sensitive actuator disposed within hand cleaner grip 120, through combinations of the above mentioned activation methods, or through other methods such as a simple on/off switch 245 (see FIG. 2) that may be disposed externally upon hand cleaner apparatus 100.

In addition to LED illumination when hand cleaner apparatus 100 is activated, activation includes vibration beginning at one or both scrubbing areas 130 and rotation of one or both finger scrubbing notches 140. Activation of scrubbing areas 130 and finger scrubbing notches 140 provides a gently abrasive scrubbing motion that can scrub a user's skin.

In a preferred embodiment, this scrubbing occurs in combination with application of a cleaning solution to a user's skin. Preferably, the cleaning solution is appropriate for the user's skin that is to be cleaned. For example, a child may choose to apply soap and water to their skin while using hand cleaner apparatus 100; a food handler in, for example, the restaurant industry, may choose to apply an even more aggressive cleaning solution than soap and water; and a surgeon may choose to apply a medicinal cleaning solution to their skin such as rubbing alcohol, hydrogen peroxide, or other appropriate cleaning solution to sterilize the surgeon's hands. Of course, these three examples are not meant to limit the scope for usage of hand cleaner apparatus 100, but merely to offer as examples.

Hand cleaner apparatus 100 may include alternate settings for length of time in which LEDs are illuminated while hand cleaner apparatus 100 is activated. For example, a parent may set a shorter time limit for their child to scrub their hands than a surgeon would set for scrubbing their hands prior to surgery.

Figure 2:
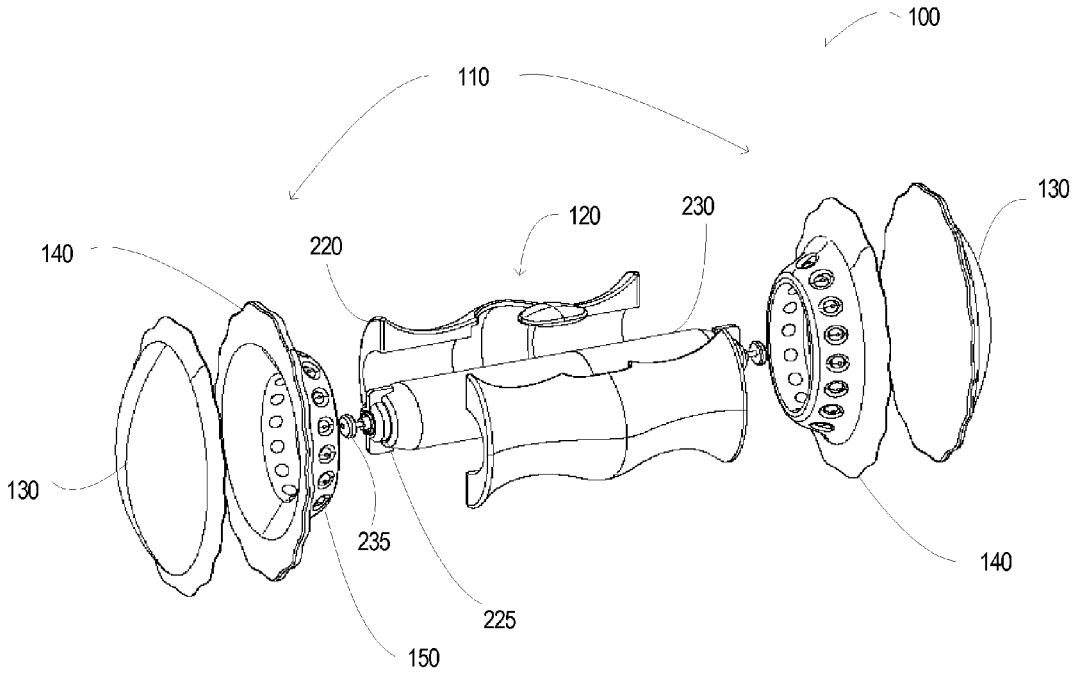
FIG. 2 is an exploded perspective view diagram showing an embodiment of the hand cleaner apparatus of FIG. 1.

FIG. 2 is an exploded view diagram showing an embodiment of hand cleaner apparatus 100. As illustrated, hand cleaner grip 120 includes a grip case 220. Grip case 220 covers a sonic motor 225 having a sonic motor housing 230. Of note, sonic motor 225 could be either a sonic or an ultrasonic motor or combination thereof, but for purposes of clarity will be referred to herein simply as sonic motor 225.

Sonic motor housing 230 contains a power source (not shown) for powering sonic motor 225. Sonic motor 225 includes a scrubber motor axle 235. Scrubber motor axle 235 is coupled to scrubbing areas 130 and finger scrubbing notches 140.

It will be appreciated by those of ordinary skill in the art that scrubber motor axle 235 may be coupled to sonic motor 230. Hand cleaner apparatus 100 may be activated to enable either or both rotation and vibration of cleaning articles such as scrubbing areas 130 and finger scrubbing notches 140. In the FIG. 2 embodiment, activation of hand cleaner apparatus 100 may occur by means of on/off switch 245.

In addition, the present inventors contemplate adding a cleaning solution container 240 to hand cleaner apparatus 100. Upon activation of hand cleaner apparatus 100, cleaning solution container 240 distributes cleaning solution contents from inside hand cleaner apparatus 100 to an external surface of hand cleaner apparatus 100. Thus, a user of hand cleaner apparatus 100 would be able to introduce a cleaning solution to the user's hand cleaning process by simply having the user activate hand cleaner apparatus 100.

This embodiment is particularly useful for parents attempting to control a child's use of cleaning solutions that may be used when a child washes their hands. Again, the disclosed embodiment is particularly useful in a hospital environment when a surgeon may prefer to have others spend time preparing the appropriate cleaning solutions to be used prior to performing surgery. A surgeon may even have multiple hand cleaner apparatuses 100 prepared to assist with scrubbing the surgeon's hands multiple times with multiple cleaning solutions.

Figure 3:
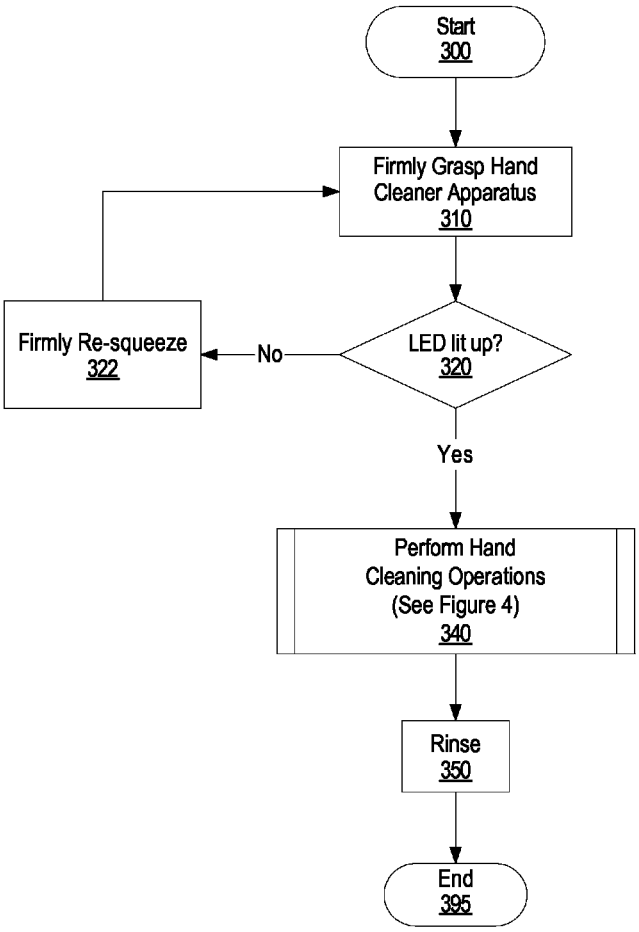
FIG. 3 is a flow diagram that illustrates a method for using the hand cleaner apparatus of FIG. 1 according to principles of the present invention.

FIG. 3 is a flowchart that illustrates steps taken for a method according to principles of the present invention when using hand cleaner apparatus 100. Hand cleaning commences at 300 whereupon at step 310 a user firmly grasps hand cleaner apparatus 100.

Although step 310 illustrates firmly grasping hand cleaner apparatus 100, step 310 is intended to demonstrate activating hand cleaner apparatus 100 in any number or combination of ways. For example, squeezing hand cleaner grip 120 could activate hand cleaner apparatus 100, but activation could also occur through abrupt movement of hand cleaner apparatus 100. In addition, a user could activate hand cleaner apparatus 100 by firmly grasping one or both of hand cleaner ends 110, or by flipping a switch 245.

Decision block 320 is where a user identifies whether activation has actually occurred. In a preferred embodiment, LED apertures 150 include LED's that illuminate upon activation of hand cleaner apparatus 100. As discussed herein, a user could also be notified of activation when hand cleaner apparatus 100 begins to vibrate or make a sound. For ease of explanation, the present disclosure limits discussion to LED activation/deactivation, and when the user recognizes that no LED illumination has occurred, as illustrated at decision block 320, "No" branch is taken when hand cleaner apparatus 100 is not activated.

At process block 322, the user can then perform further actions to attempt to activate hand cleaner apparatus 100. Specifically, in the illustrated embodiment, the user can re-squeeze hand cleaner apparatus 100 until activation. Upon activation, "Yes" branch is taken when the LED's have illuminated.

At process block 340, hand cleaning operations are performed until hand cleaner apparatus 100 deactivates. Upon completion of hand washing, process block 350 indicates that a user will rinse their hands as well as hand cleaner apparatus 100 prior to completion of the hand cleaning method of FIG. 3 at process oval 395.

As previously disclosed herein, deactivation may occur automatically pursuant to a timer setting or manually upon a user's choice. Although in the disclosed embodiments, deactivation is often described as automatically occurring subsequent to a predetermined period of time as indicated by a timer that begins after activation of hand cleaner apparatus 100, in other embodiments, deactivation may also occur through a manual operation of the user.

Figure 4:
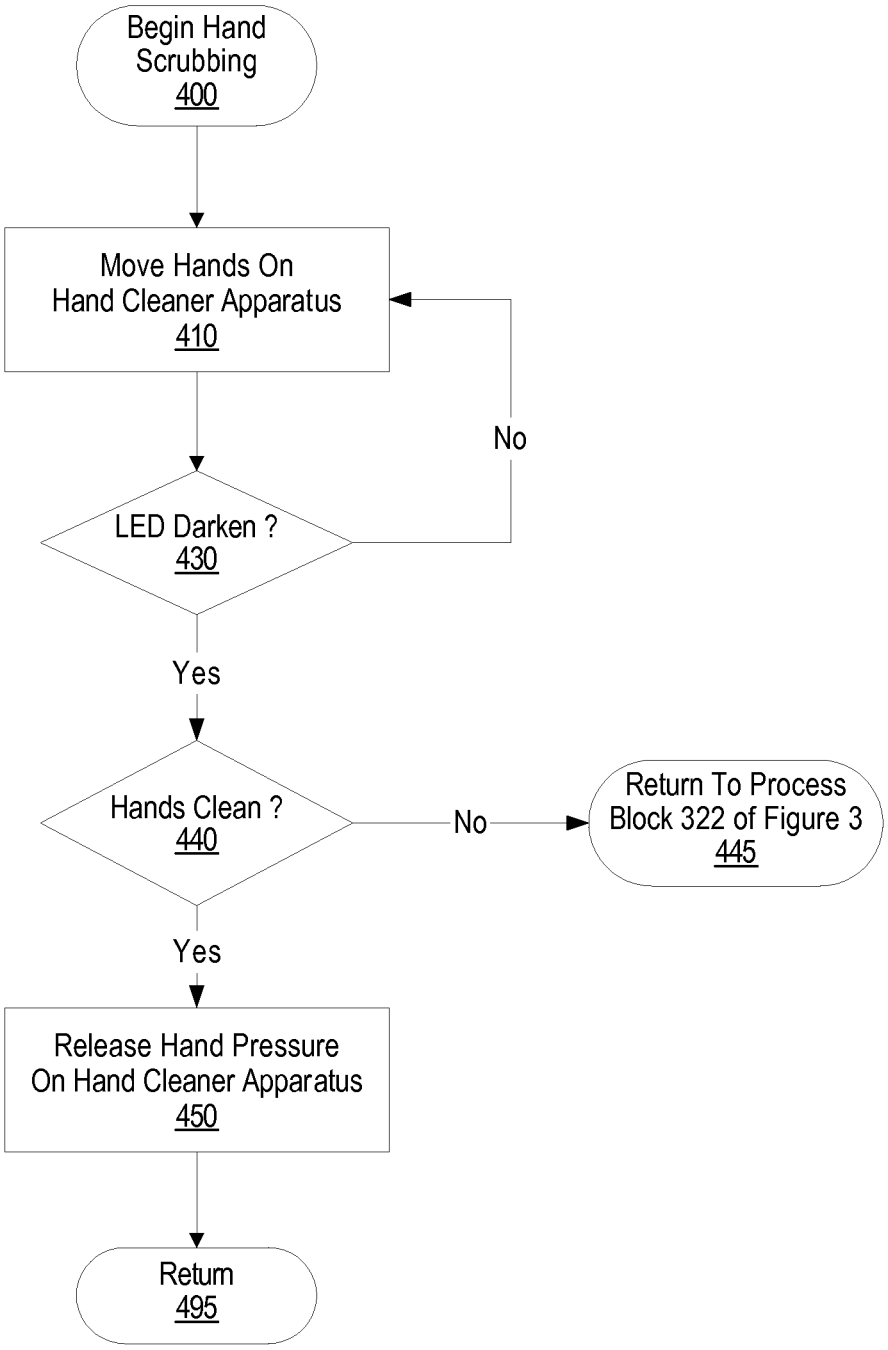
FIG. 4 shows a flow diagram that illustrates a more detailed description of a portion of the method described in relation to FIG. 3.

FIG. 4 is a flow diagram that illustrates a more detailed description of process block 340. Scrubbing commences at process block 400 whereupon hands are aggressively moved upon activated hand cleaner apparatus 100. Of course, hand cleaner apparatus 100 could be used to clean other portions of a user's body, but the enhanced abrasiveness of hand cleaner apparatus 100 is conducive to more durable areas of the user's skin. For purposes of explanation, the description is limited to a user's hands.

A user's hands are moved upon hand cleaner apparatus 100 in various ways until hand cleaner apparatus 100 deactivates. As previously disclosed herein, for purposes of efficiency, the deactivation description disclosed herein is limited to LED darkening signals, but deactivation could be signaled by any number of techniques such as LEDs changing state/colors, audible sounds such as music changing state, vibration ceasing, manual deactivation, and so forth.

In FIG. 4, deactivation of hand cleaner apparatus 100 is indicated when illuminated LED's darken that are visible through LED apertures 150. As illustrated at decision block 430, if the illuminated LEDs have not darkened, "No" branch is taken and the user continues to move their hands upon hand cleaner apparatus 100. Otherwise, "Yes" branch is taken because the LED's have darkened and hand cleaner apparatus 100 has deactivated—either automatically or otherwise.

The user then inspects their hands at decision block 440. If it is determined that the user's hands are not yet adequately clean, "No" branch is taken and step 445 indicates that the hand cleaning method returns to process block 322 of FIG. 3 where hand cleaner apparatus 100 is again activated and the hand cleaning process repeats. Otherwise, "Yes" branch is taken and step 450 indicates that hand pressure is released upon hand cleaner apparatus 100 at which point completion oval 495 indicates that the cleaning process returns to rinse step 350.

The included functional descriptive material is information that imparts functionality to a machine. This functional descriptive material includes, but is not limited to the presently disclosed hand cleaner apparatus 100.

While particular embodiments of the present invention have been shown and described, based upon the teachings herein, it will be appreciated by those skilled in the art that changes and modifications may be made without departing from the principles of this invention and its broader aspects. Therefore, the appended claims are to encompass within their scope all such changes and modifications as are within the true spirit and scope of this invention. Furthermore, it is to be understood that the invention is defined by the appended claims.

It will be understood by those with skill in the art that if a specific number of an introduced claim element is intended, such intent will be explicitly recited in the claim, and in the absence of such recitation no such limitation is present. For non-limiting example, as an aid to understanding, the following appended claims contain usage of the introductory phrases "at least one" and "one or more" to introduce claim elements. However, the use of such phrases should not be construed to imply that the introduction of a claim element by the indefinite articles "a" or "an" limits any particular claim containing such introduced claim element to inventions containing only one such element, even when the same claim includes the introductory phrases "one or more" or "at least one" and indefinite articles such as "a" or "an"; the same holds true for the use in the claims of definite articles.

What is claimed is:

1. An apparatus comprising:

a sonic motor enclosed within an elongate pressure sensitive casing, the sonic motor including a motor housing within which the sonic motor is disposed, the sonic motor being mechanically coupled to both a power source and a cleaning solution dispenser which are also enclosed within the motor housing, the motor housing being disposed within the elongate pressure sensitive casing, the casing having at least one actuator built in and the at least one actuator configured to activate at least a timer, an indicator, the cleaning solution dispenser, and the sonic motor, all disposed within the apparatus, the actuator enabling both activation of the apparatus after pressure is applied to the casing and deactivation of the apparatus after passage of a predetermined period of time subsequent to activation of the apparatus;

a first and a second scrubbing head disposed at a first and a second end of the apparatus, respectively, the scrubbing heads being mechanically coupled to each end of the sonic motor such that the scrubbing heads are rotated by the sonic motor when the sonic motor is activated; and at least one indicator electronically coupled to the power source and the timer, the at least one indicator being disposed such that, when activated, the at least one indicator is apparent outside of the elongate pressure sensitive casing of the apparatus, the at least one indicator being activated when pressure is applied upon the pressure sensitive casing and the indicator being deactivated when the timer exceeds the predetermined period of time.

2. The apparatus of claim 1 wherein the at least one indicator comprises a signal light.

3. The apparatus of claim 2 wherein the signal light comprises a light emitting diode (LED).

4. The apparatus of claim 1 wherein the at least one indicator comprises an audible signal.

5. The apparatus of claim 1 further comprising the at least one indicator being configured to manually deactivate through releasing pressure on the actuator.

6. The apparatus of claim 1 wherein the actuator is activated by manually selecting an activation switch position, the activation switch being visibly disposed upon the apparatus.

7. The apparatus of claim 1 wherein the timer that is electronically coupled to the at least one indicator measures passage of time only while pressure is applied to the pressure sensitive casing.

8. The apparatus of claim 1 wherein the at least one actuator of the casing includes an activator that activates the sonic motor through abrupt movement of the apparatus.

9. The apparatus of claim 1 wherein each of the first and second scrubbing heads include both a scrubbing area that vibrates upon activation and a finger scrubbing notch that both rotates and vibrates upon activation.

10. A method of cleaning hands, the method comprising:

activating a hand cleaner apparatus that includes an elongate hand cleaner grip having two hand cleaner ends, each hand cleaner end having a scrubbing area and a finger scrubbing notch, the hand cleaner apparatus also including a sonic motor having a motor housing, the sonic motor and sonic motor housing being enclosed within the elongate hand cleaner grip with a power source and timer also being disposed within the elongate hand cleaner grip, the sonic motor including an axle, the axle being mechanically coupled to the scrubbing areas and the finger scrubbing notches wherein, in operation, the sonic motor causes vibration in the scrubbing areas and rotation and vibration of the finger scrubbing notches, the hand cleaner apparatus also including an activator disposed within the hand cleaner apparatus for activating the sonic motor and timer, and the hand cleaner apparatus further including at least one LED (light emitting diode) being electronically coupled to the timer, the activator, and the power source, the at least one LED being disposed within the hand cleaner apparatus such that when the hand cleaner apparatus is activated the at least one LED is visibly illuminated for a predetermined amount of time and the at least one LED changes state subsequent to passage of the predetermined amount of time following activation of the hand cleaner apparatus;

performing hand cleaning operations upon the activated hand cleaning apparatus;

rinsing hands and hand cleaner apparatus when the at least one LED changes state; and releasing the hand cleaner apparatus.

11. The method of claim 10 wherein said performing hand cleaning operations comprises moving hands about the activated hand cleaner apparatus in an aggressive manner such that a gently abrasive scrubbing of skin occurs where the activated scrubbing areas and finger scrubbing notches contact the hands that are moved about the activated hand cleaning apparatus.

12. The method of claim 10 wherein said performing hand cleaning operations further comprises adding a hand cleaning solution to a surface area of the activated hand cleaning apparatus.

13. The method of claim 12 further comprising analyzing hands to determine whether the hands have been satisfactorily cleaned by the previously performed hand cleaning operations.

14. A hand cleaner apparatus comprising:

an elongate hand cleaner grip having two hand cleaner ends, each hand cleaner end having a scrubber area and a finger scrubber notch;

a power source disposed within the elongate hand cleaner grip;

a sonic motor having a motor housing, the sonic motor and housing being enclosed within the elongate hand cleaner grip, the sonic motor including an axle, the axle being mechanically coupled to the scrubber areas and the finger scrubber notches wherein, in operation, the sonic motor causes vibration in the scrubber areas and rotation and vibration of the finger scrubber notches;

an activator disposed within the hand cleaner apparatus for activating the hand cleaner apparatus; and an indicator being electronically coupled to the activator and the power source, the indicator being disposed within the hand cleaner apparatus such that when the hand cleaner apparatus is activated the indicator demonstrates activation of the hand cleaner apparatus.

15. The hand cleaner apparatus of claim 14 wherein a cleaning solution container is disposed within the elongate hand cleaner grip, the cleaning solution container being coupled to a cleaning solution pathway for transmission of a cleaning solution from within the elongate hand cleaner grip to a location external to the hand cleaner grip.

16. The hand cleaner apparatus of claim 14 wherein the indicator is a light emitting diode that is visibly illuminated for a predetermined amount of time upon activation of the hand cleaner apparatus and that changes state subsequent to passage of the predetermined amount of time following activation of the hand cleaner apparatus.

17. The hand cleaner apparatus of claim 14 wherein the indicator is an audible signal that is apparent upon activation of the hand cleaner apparatus and that changes state upon deactivation of hand cleaner apparatus.

18. The hand cleaner apparatus of claim 14 wherein the indicator is a combination of at least one light emitting diode and an audible signal.

19. The hand cleaner apparatus of claim 14 further comprising a timer configured to measure a predetermined activation time for the hand cleaner apparatus.

20. The hand cleaner apparatus of claim 14 wherein the indicator comprises vibrations caused by the sonic motor from within the hand cleaner apparatus.

* * * * *